United States Patent [19]

Ehedy et al.

[11] 4,197,723

[45] Apr. 15, 1980

[54] STITCH BONDED FABRICS, METHOD AND APPARATUS FOR MAKING THE SAME

[75] Inventors: Gustav Ehedy, Augustusburg; Heinz Kemter, Karl Marx Stadt; Wilfried Ponitz, Plauen; Engelbert Ehrlich, Flöha; Walter Politze, Karl Marx Stadt; Walter Scholtis, Karl Marx Stadt; Wolfgang Wunsch, Karl Marx Stadt, all of German Democratic Rep.

[73] Assignee: VEB Wirkmaschinenbau Karl-Marx-Stadt, Fed. Rep. of Germany

[21] Appl. No.: 906,189

[22] Filed: May 15, 1978

Related U.S. Application Data

[62] Division of Ser. No. 823,361, Aug. 10, 1977, Pat. No. 4,158,292.

[51] Int. Cl.[2] ..... D04B 23/06

[52] U.S. Cl. ..... 66/85 A; 66/192

[58] Field of Search ..... 66/84, 84 A, 85 A, 83, 66/190–195

[56] References Cited

U.S. PATENT DOCUMENTS

| | | | |
|---|---|---|---|
| Re. 28,718 | 2/1976 | Ehrlich et al. | 66/85 A |
| 3,646,780 | 3/1972 | Wildeman | 66/85 A |
| 3,760,607 | 9/1973 | Wildeman | 66/85 A |
| 3,967,472 | 7/1976 | Wildeman | 66/85 A |
| 3,991,593 | 11/1976 | Bernert et al. | 66/85 A |

*Primary Examiner*—Ronald Feldbaum

*Attorney, Agent, or Firm*—A. C. Nolte, Jr.; Edward B. Hunter

[57] ABSTRACT

A fabric composed of a fleece or backing of fibrous material with parallel rows of single thread, sewn-knitted, run resistant, stitches superimposed thereon; a method of making the fabric and a warp knitting machine which is suitable for the production of the sewn-knitted fabric. The fabric can advantageously be used for outer garments, household or space textiles.

14 Claims, 4 Drawing Figures

STITCH BONDED FABRICS, METHOD AND APPARATUS FOR MAKING THE SAME

This is a division of application Ser. No. 823,361 filed Aug. 10, 1977, now U.S. Pat. No. 4,158,292.

PRIOR ART

In the textile goods described in the German Auslegeschrift No. 1,952,558 and the German Offenbarungscchrift No. 2,157,947, it is of primary importance, for the prevention of runs or laddering as it may be called, to intertwine with each thread stitch, one fiber stitch or fiber loop, in the form of an additional system of stitches made of fiber whereby each fiber stitch is pulled from the fleece or backing material through a thread stitch and the following thread stitch extends through the head of the fiber stitch. The fiber stitches measured from head to foot have approximately the length of the distance between two consecutive stitch holes of a longitudinal row. The knitting machines which are used to make these fabrics provides support for the fleece and for the lateral limits of the passage space for the fleece, such support taking the form of straight or bent counter-hold pins on that side of the fleece which faces the eye-pointed needles or thread guides. The fleece structure of the textile goods to be produced in this prior art apparatus is disadvantageously subject to mutilation or at least to too great a change during stiching. Furthermore, the existing apparatus does not operate with the necessary accuracy for producing higher quality textile goods.

OBJECTS OF THE INVENTION

One purpose of the present invention is to improve the known textile goods and apparatus which make them to such an extent that they can be used for the development of considerably expanded fields of application. Particularly, the invention contemplates avoiding the disadvantages which occur as a result of the prior art laddering prevention via fiber stitches or fiber loops, in the sense of an additional system of fiber stitches and yet to retain the fiber stitch system, but in a much more acceptable form.

The suface structure of the above discussed prior art textile goods includes a relatively high content of the backing or fleece fibers formed with the stitches. However, the slide needles, pulling the fiber from the fleece causes excessively large perferations in the fabric which in turn results in a non-uniform appearance and surface roughness of the goods. The sewn-knitted fabric of the invention contains no additional system of fiber stitches, but rather a multitude of fibers within the thread stitches, thus impeding laddering but in a considerably less conspicuous and sufficiently effective way and resulting in good uniformity and surface smoothness. Prerequisites for the successful use of the sewn-knitted fabric for new areas of application, such as outer garment use, are thus obtained.

By necessity, a machine is required for the production of such a sewn-knitted fabric which assures an exact execution of the production process with predetermined adjustment parameters over a long period of time. In addition, the machine must have versatile capabilities. The prior art counter-hold pins provide a specific shape and have to be changed if the configuration of the pin does not satisfy technical requirements. Such prior art structures, therefore, do not provide versatility. Furthermore, with the provision of the prior art counter-hold pins, the passage space for the fleece was too resilient resulting in a relatively large area of fleece fiber pickup in the slide needle which was opened in the fleece and thereby almost required the interposition of a fiber mesh system on the thread loops if any interlacing of the fibers was to be obtained at all. In contrast to the prior art systems, the passage space for the fleece in the apparatus of the present invention remains unchanged during the operation of the warp knitting machine since the flexible counter hold pins of the prior art have been replaced by a rigid counter hold comb.

With the provision of the counter hold comb of the invention and the adjustability thereof, the requirement to change individual elements in the machine for different technical requirements of a textile product is eliminated. Also, adjustments of the slide needles is obviated with the provision of the adjustable counter hold comb of the invention, thus saving time and adding to the life of the slide needles.

Thus the objects of the invention include the provision of a warp knit fabric, particularly a sewn-knitted fabric which due to the fleece fibers situated in the stitch holes is not subject to laddering or running or continuous ripping of the thread stitches and is so designed so that the beginning of runs or ripped opened rows are stopped with normal loads on the thread at stitch-fiber meshed stopping points. This object of the invention is accomplished without the provision of an additional fiber stitch or mesh system.

The invention also provides a warp knitting machine for producing the fabric of the invention in which the passage space for the fleece remains constant during the run of the machine but which during standstill can be adjusted in a simple and reliable manner to a different fleece thickness. The warp knit fabric of the invention is characterized by a combination of the folllowing types of interlacing of fibers and threads in the following quantity ratio:

(a) fibers which due to shifting within the fleece are loomed or pulled into at least a large number of stitch holes, and are closely connected or bunched within the stitch holes with the theads of the stitches;

(b) in many of the stitch holes provided with loomed in fibers according to feature a, some of such fibers have ends which are long enough to be in the thread stitches on the right or needle side of the goods;

(c) in some of the stitch holes provided with loomed in fibers according to feature a, the ends of the fleece fibers are somewhat longer than the others and interlace loosely into the thread stitches of the "right" side of the goods;

(d) in a portion of the stitch holes with loomed in fibers according to feature a, the fleece fibers have such a length that they are interlaced in a stitch like manner with the thread stitches of the "right" side of the goods;

(e) in a portion of the stitch holes having loomed in fleece fibers according to feature a, the fleece fibers form stitch like fiber hooks through the upper part of which a thread stitch of the "right" side of the goods is pulled;

(f) the quantity of the interlacing of the thread and fiber of the type described in type c is less than that of b and the quantities of types c, d and e decrease in that sequence.

The various possible types of interlacing of fibers with threads according to the characteristics labeled a to e above are contained in variable frequency in the sewn-kint fabrics of the invention. Although some of the stitch holes are "empty" of loomed in fibers as described in a above, almost all stitch holes do have such fibers and the respective contents of the types b to e as described above decrease steadily in the sequence b to e, so that the stitch like fiber hook described in paragraph e occurs in lesser quantities than the other types of fiber thread interlacing. The second largest type of thread fiber interlacing has the characteristics described in paragraph b, and so on.

Furthermore, the sewn-knit fabric may encompass the characteristics a through e and all possible combinations thereof so that in various stitch holes one type or another may be encountered in addition to another or third, fourth or fifth type.

A certain amount of stitch holes may be occupied with only one interlacing type a through b, but in general, the interlacing types of the fibers do not form a system of fiber stitches or fiber loops. Only a noncharacteristic small part of the fleece fiber content is therefore used to prevent runs of laddering of the thread stitches.

The original fleece structure therefore, remains largely unimpaired inasmuch as the variable frequency of the interlacing types a through e to be encountered also provides a compensation of the fiber groupings which are not of similar thickness; the thicker groupings being in the minority.

It may be noted that the involved fiber quantity per thread stitch has an amount as an upper limit which appears in the form of a stitch like fiber hook which, as mentioned before does not occur as often per surface unit as any other "low" type of interlacing fibers coinciding with the thread stitches. It has been determined that a stitch like fiber hook, in contrast to a fiber stitch is the length of two consecutive stitches of the "right" side of the goods and that it is not as strong as a fiber stitch. The "low" types of interlacing of fibers with threads can also extend over two or even more consecutive thread stitches.

The invention also contemplates the provision in a warp knitting machine particularly of the sewing knitting variety for the production of sewn knit fabric made of fleece, preferably fiber fleece, and which warp knitting machine provides the usual series of separate pointed slide needles, with hooks which can be closed or locked by means of locking wires. The machine also provides thread guiding eye-pointed needles located opposite the slide needles, a knock over comb and a counter hold comb for the support of the fleece during the piercing of the fleece by the needles and a bar, which limits the passage space of the fleece and is disposed below the slide needles as well as opposite the knock over comb. The counter hold comb is designed as a rigid structure, positioned at an angle to the slide needles and including sinker shaped prongs at the free ends of the comb teeth positioned opposite the slide needles and located in the front of the inner surface of the bar with the bar positioned a distance from the sinker shaped prong below the slide needles.

As will become clear from the following description of the invention taken in conjunction with the drawings, the machine construction provided by this invention results in the versatility and capabilities previously discussed. dr The drawings are as follows.

Figure 1:
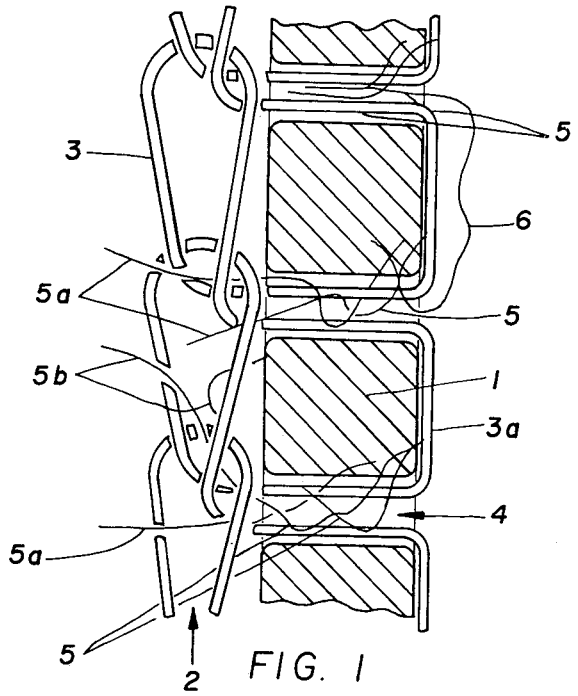
FIG. 1 is a cross-section greatly enlarged through a sewn knit fabric which has a row of chain stitches sewn therein and in which the stitches as somewhat diagrammatically shown for clarity.

According to FIG. 1, the sewn-knit fabric consists of a fleece 1, which is reinforced by means of a multitude of parallel rows 2 of stitches 3. Natural fibrous material, as well as chemical fibrous material, or a mixture of both, may be used for the production of the fleece 1. The fibers may be arranged in fleece 1 predominately extending the same direction, or crossed. Fleece 1 may also be a so-called "irregular fleece" in which the fibers have no directional system and form an unarranged or disorderly fiber pattern. Ramming machines, beaters, roller cards and flat cards, may be used, for instance, as fleece-forming machines. The fleece 1 may be composed of one or several layers or fleece. The fleece 1 may be in the form of a rather loose fibrous or of a surface-stable fibrous structure. It is also possible that threads or strips of foil are added to the fleece 1, or that the fleece consists of threads or foils or some other material alone. For all types of fleece the terms fiber fleece or backing material is used in the text which follows.

Figure 2:
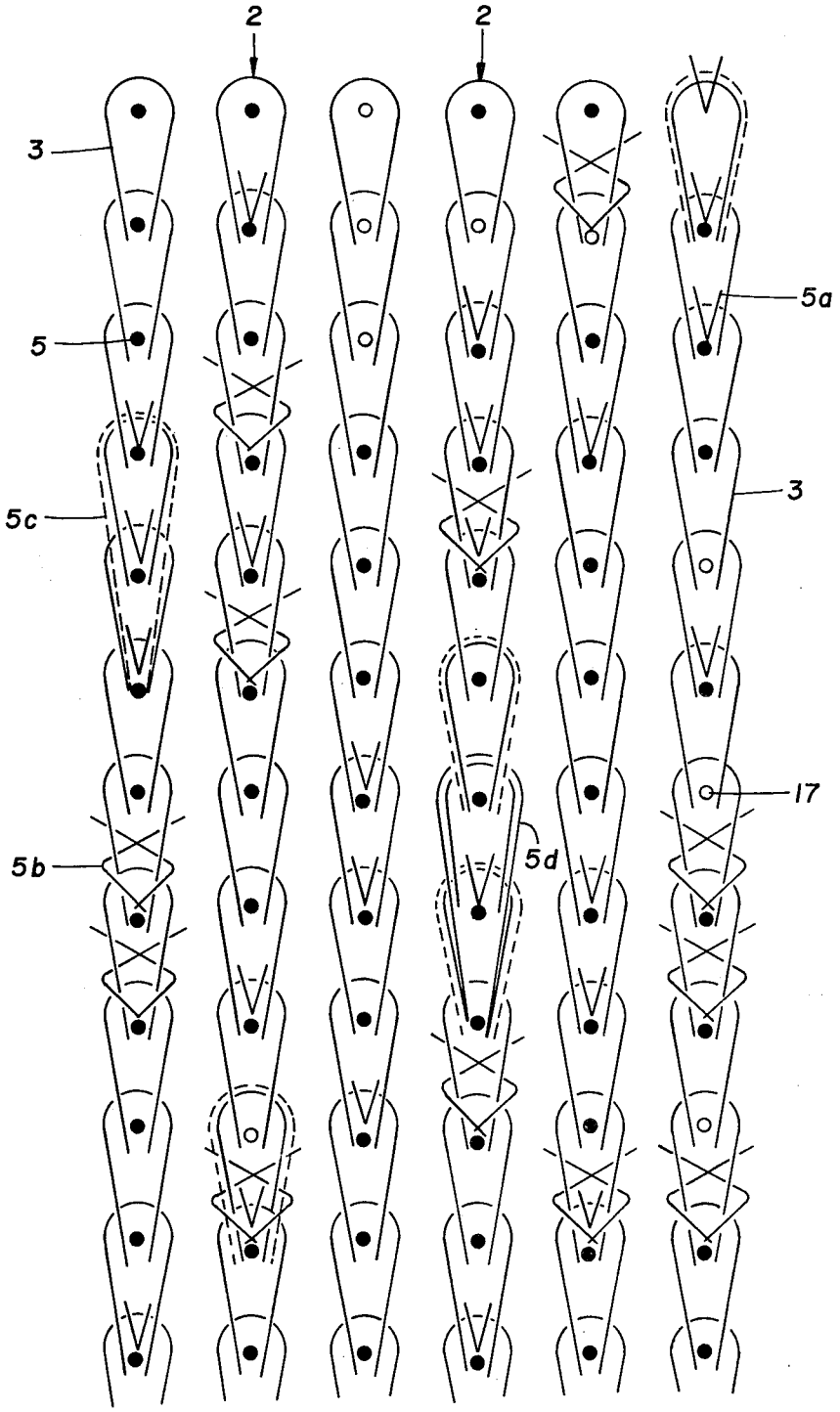
FIG. 2 is a schematic drawing on a large scale of the stitches of the "right" side of the sewn knit fabric according to the invention and in which the various types of interlacing of fibers with threads are shown in simplified schematic form.

The parallel rows 2 of stitches 3 which reinforce the fiber fleece 1 run in a longitudinal direction to the fiber fleece 1 that is, in fabric shown, in the direction of movement of the fiber fleece as it is processed on a sewing-knitting machine. Each row 2 of the longitudinally running stitches 3 is the result of many individual stitches which are produced from one thread, in contrast to stitch connections where two stitches per knitting cycle are formed on a needle, for which purpose two threads have to be used. The longitudinally running parallel rows 2 of stitches 3 can be connected with each other via transverse or diagonal courses of the thread for forming tricot, cloth, or velvet texture formations or arranged simply without mutual interconnection, as shown, for forming a chain stitch texture or simple chain-stitch seams parallel to each other. In the case of textures such as tricot, cloth or velvet, the transverse or diagonal connections of the longitudinal rows of stitches 2 are located on the "left" side of the sewn knit fabric while the chain-stitch texture has only vertical connecting parts 3*a* for the stitches 3. The vertical connecting parts 3*a* are provided on the "left" side of the sewn-knit fabric but are shown on the right side of the fabric in FIG. 1. Due to fibers 5, 6 or parts of fibers of the fiber fleece 1 which have a different length and which are located in the stitch holes 4, the stitches 3 are prevented from being ripped along any substantial distances in a row and thus will not ladder or form runs. The sewn-knit fabric is so constituted that the beginning of a run or an unravelled row is stopped at the normal load of the thread stitch, such that stopping points occur on the surface of the fabric. The special and inventive structure of the sewn-knit fabric lies in a combination of various types of interlacings of fibers with threads and in the fact that the interlacing types occur in a quantitative ratio with each other. The following types of interlacings of fibers with threads occur on the sewn-knit fabric of the invention:

(a) fibers 5, 6, which, due to the movement of the needle and thread and the consequent shifting of the fibers within the fiber fleece 1, are loomed or pulled in at least into a plurality of stitch holes 4, and are in these stitch holes 4 in close contact, that is, bunched around and with the threads of the stitches 3;

(b) in many of the stitch holes 4 provided with loomed in fibers 5, according to characteristic a, some of these fibers 5*a* have ends which are long enough to be in the stitches 3 on the "right" side of the goods;

(c) in a portion of the stitch holes 4 according to feature a, the ends 5*b* of fibers 5 are longer than the other ones and interlace loosely into the stitches 3 of the "right" side of the goods;

(d) in a portion of the stitch holes 4 according to feature a, fibers 5 have such a length that the same are stitch-like interlaced with the stitches 3 of the right side of the goods and appear as stitch-like interlacings 5*c* (FIG. 2).

(e) in a portion of the stitch holes 4 according to feature a, fibers 5 form a stitch-like fiber hook 5*d*, through the upper parts of which is pulled one stitch 3, on the right side of the goods.

Figure 3:
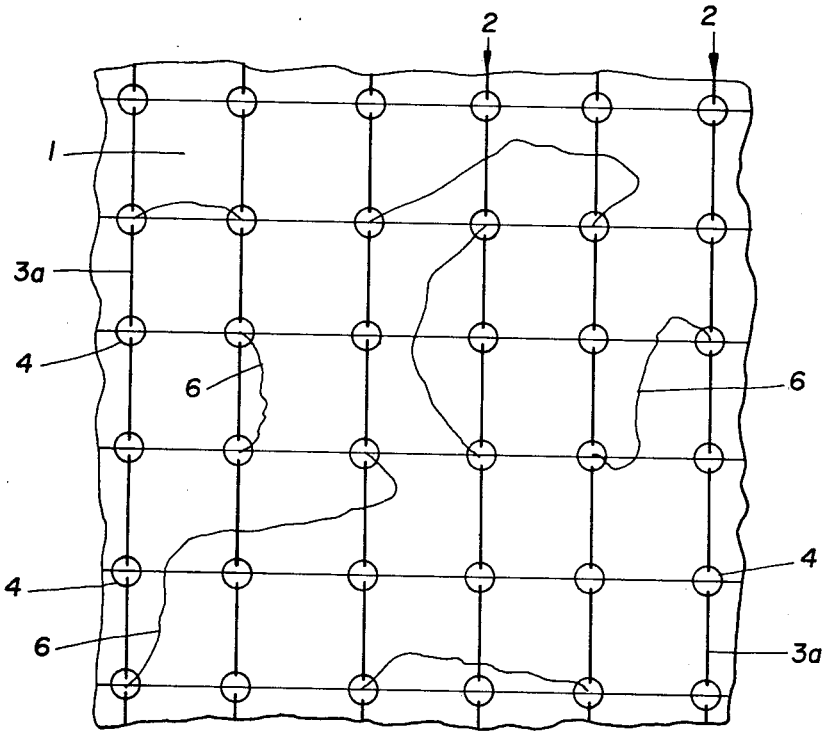
FIG. 3 is a plan view of the "left" side of the sewn knit fabric according to FIG. 1.

Fibers 5, 6 which have been loomed into stitch-holes 4, as a result of shifting within the fiber fleece 1, may extend over two or more stitch-holes 4. In one instance, this may pertain to the stitch-like fiber hook 5*d*, a stitch-like interlacing 5*c* or another type of interlacing of the right side of the goods; in another instance, the "left" side of the goods may include loomed-in fibers 6, as can be seen especially in FIG. 3, which also contribute to the prevention of runs, and may extend from one, two or several stitch holes 4. The presence of fibers 6 on the "left" side is partially caused by the fact that the slide needles, during their forward-movement, push fibers out of fleece 1 and take the same back again during the subsequent backward-movement. The fibers 5 and 6, which are loomed in into stitch holes 4, are located in stitch holes 4 of longitudinal rows, as well as of cross rows. They run, particularly on the "left" side of the goods, sometimes diagonally to the direction of movement of the fabric through the machine. The fibers 5 and 6 stem, as a rule, from the "left" side of the fleece because the open hook of the needle travels from that side to the "right" side pulling the thread from the "left" side. The fibers 5*a* to *d*, which are intertwined with the thread stitches 3 on the "right" side of the goods are situated, relative to the stitches 3, thereupon, thereunder or adjacent thereto and are placed around a stitch. Particularly favorable results are obtained with sewn-knitted fabrics the stitches 3 of which are rather short and in which the parallel rows 2 are at very short distances from each other.

Figure 4:
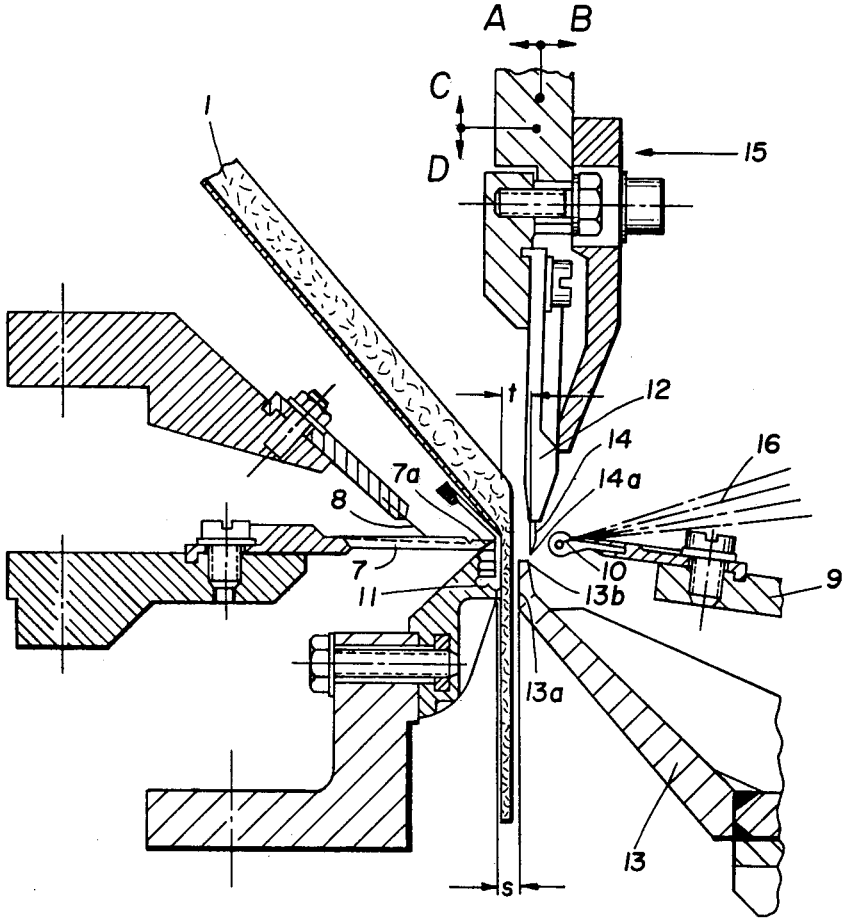
FIG. 4 is a cross-section of a sewing-knitted machine at the stitch formation location thereof and which is equipped to produce the sewn-knit fabric shown in FIGS. 1 through 3.

In FIG. 4 only that portion of the sewing-knitting machine at its stitch-forming area is disclosed, since the rest of the machine components are generally known and require no special illustration.

Essential components of the sewing-knitting machine are the pointed slide needles 7 the hooks of which are lockable by means of locking wires 8. Disposed opposite the points 7*a* of the slide needle 7, a guide bar 9 carries thread-guiding eye-pointed needles 10. The slide needles 7 penetrate, that is pass between the teeth of a knock over comb 11 which, together with a counter-hold comb 12, substantially defines the two sides of the passage space for the fiber fleece 1. The counter-hold comb 12 has the further function of providing back up support for the fiber fleece 1, when the same is pierced by the slide needles 7. Below the slide needles 7 and opposite the knock over comb 11, a sinker bar 13 provides at its upper end a flange which acts, with the counter-hold comb 12, as a supplemental fleece retainer, and also defines with knock over comb 11 the lower portion of the passage space of the fiber fleece 1. The counter-hold comb 12 is constructed as a rigid arrangement positioned at an angle to the slide needles 7, and includes sinker shaped prongs 14, the outer free ends 14*a* of which are disposed ahead or upstream, of the plane of the inner surface 13*a* of the bar 13 and laterally outwardly thereof. There is a space between the sinker shaped prongs 14 and the upper edge 13*b* of the bar 13 provided below the slide needles 7. This space may be present, as shown, in both the horizontal and vertical direction but, in special cases, may occur either horizontally or vertically. Preferably, the outer ends 14*a* of the sinker shaped prongs 14 are positioned approximately at the level of the lower edge of the slide needles and farther removed from the knock-over comb 11 than the inner surface 13*a* of the bar 13. For the general universal adjustability of the passage space for the fiber fleece 1, the holder 15 of the counter-hold comb 12 is so designed that the counter-hold comb 12 can be adjusted in directions AB or CD. The same applies for the bar 13 which is also fashioned in a manner whereby it is universally adjustable.

The rigidity of the counter-hold comb 12, particularly that of sinker shaped prongs 14, results in the assurance of maintaining a precise position for an exact dosing of the amount of fibres to be grasped by the slide needles 7. This eliminates any unreliability which inevitably occurs when counter-hold devices which are flexible or yielding to the forces engendered by the slide needles piercing the fleece are used. The outer ends 14*a* of the prongs 14 are, in almost all cases, designed as points with one diagonal edge, respectively, facing the eye-pointed needles 10, whereby the edge extends at different steepnesses, depending upon the purpose for which it is used. The diagonal edges serve for the sliding off of the diagonal cross-connections of the threads of the tricot stitch, cloth or velvet texture structures from the prongs 14. Thus, such cross-connections cannot form any hooks or only very small ones, which can be compensated during the pulling-together of the thread stitches 3. When sewing a simple chain stitch texture, the slanting is needed very rarely, such as when space has to be created for a close approach of the eye-pointed needles 10 to the prongs 14.

The process of producing the sewn-knitted fabrics is the following:

The sewing-knitting machine is supplied via appropriate guide devices with a fiber fleece 1 which then arrives between the knock-over comb 11, on one hand, and the counter-hold comb 12 as well as the bar 13, on the other hand. The fiber fleece 1 thus transverses its passage space at the stitch-forming area. The passage way is limited by a straight surface on the side of the knock-over comb 11, while the side of the counter hold comb is characterized by an offset which is present due to different horizontal spacing of the counter hold comb 12 and the bar 13 in relation to the knock-over comb. The offset in the passage space creates a slight stowing of the conveyed fiber fleece 1 in the vicinity of the slide needles 7 and effects a tighter fit of the passage space to the thickness of the finished sewing-knit fabrics beneath the slide needles 7. The passage space is characterized by the ratio of the inner widths t and s. The fiber fleece 1 or the finished sewn-knitted fabric is pulled off in a downward direction by means of a conventional pull-off device which may operate intermittently or continuously. The slide needles 7 pierce through from the "right" side of the fiber fleece 1 into the same, penetrating it completely (FIG. 4 shows this process from the left—the "right" side is the side of the stitches 3). The locking wires 8, also coming from the right side of the fiber fleece, pierce through the fiber fleece completely. After the complete penetration of the fiber fleece 1 by the slide needles 7 and the locking wires 8, the eye-pointed needles 10 place warp threads 16 into the open hooks of the slide needles 7, which are in their forewardmost position. subsequently, the slide needles 7 and the locking wires 8 withdraw in such a fashion that the hooks of the slide needles 7 remain open until the fibers 5, in a predetermined amount, have been grasped. Th closing of the hooks occurs before too many fibers 5 enter the hooks. Preferably, the hooks are closed in the vicinity of the left side of the fleece. For this purpose, the slide needles 7 and the locking wires 8 have adjustable drives which are commonly used for sewing-knitting machines and which permit a kinematical adaptation to all circumstances (relationships or ratios) which may occur. The fibers 5 grasped by the hooks are subsequently pulled, together with the warp threads 16, in the direction of the "right" side of the fleece. Depending upon the length of th grasped fibers 5 and upon the position which they, or their ends, respectively, had before they were grasped, the fibers 5 are shifted in the fiber fleece 1 a shorter or longer distance, or they are taken along up to the rearward position of the slide needles 7. The hooks of the slide needles 7 remain closed until they leave the fiber fleece 1, and open up when the surface of the "right" side of the fleece had been passed. By the time the rearward position of the slide needles 7 has been reached, some fibers 5 may have already left the hooks, because they are either not long enough or because they had not been grasped securely enough. Such fibers 5 then form the types **5*a* and 5*b* of interlacings of fibers 5 with threads. Longer fibers 5, which form type 5*c*, are still guided by the slide needles 7 in the phase of the rearward position of these slide needles 7 and free themselves soon thereafter. Other fibers 5 have remained at the end position in the hooks in the form of loops. In some stitch holes 17, small fibers 5 are merely pulled in. (FIG. 2). Since the hooks are now open and the slide needles 7 have again a tendency to move forward, the fibers 5 and warp threads 16 slide from the hooks onto the needle shanks and above the locking wires 8. At this time, no fibers 5 adhere any longer to the vast majority of the shanks of the slide needles 7. Only a very small number of slide needles 7 still carry fibers 5, from which later stitch like fiber hook 5*d* is formed. Also for the formation of the interlacing-type 5*c*, the slide needles 7 still carry fibers 5 and, at that, not as few as for the type 5*d*. The fibers 5 of the interlacing type 5*c* and of the stitch like fiber hook type 5*d* which are pulled out of the fiber fleece 1 are just as long as the warp thread loops. The warp thread loops become smaller again as a result of the thread pull. On the other hand, the forerunners of the interlacing-type 5*c* and of the stitch like fiber hooks 5*d* remain in the magnitude of their original formation, because they are ineleastic and not subject to a thread pull. Thus, the prerequisite has been achieved that the interlacing-type 5*c* and the stitch-like fiber hooks 5*d* each have approximately twice the finished size as the stitches 3 from the warp threads 16. For this purpose, the slide needles 7 are pulled back so far until the throats of the hooks are removed from the "right" side of the fiber fleece 1 by a distance which corresponds approximately to twice the finished length of a stitch 3. However, the distances may also be larger or smaller. Furthermore, the fibers 5 assume in the needle hooks the position in relation to the warp thread loops as is dictated by this distance. As indicated, the slide needles 7 are then moved forwardly and the hooks are opened. The opening of the hooks occurs as a result of the pulling back of the locking wires 8. At the time the slide needles 7 had assumed their rearward position, the usual pull-off device then became effective. Rushing after the slide needles 7, the locking wires 8 move now also forwardly. The fiber fleece 1 is moved forwardly by the action of the slide needles 7 and the locking wires 8 until it butts against the counter-hold comb 12 and the bar 13. Thereafter, the slide needles 7 and the locking wires 8 reach their forwardmost position, the locking wires somewhat later, and the warp thread loops surround the needle shanks more tightly than the longer, inelastic fiber structures which have been pulled loose from the fleece and will form the interlacing-types 5*c* and 5*d*. The hooks again receive warp threads 16 and fibers 5, as previously described. Subsequently, the slide needles 7, together with the locking wires 8, are pulled back under conditions as have already been described. Prior to reaching the rearward position and after the slide needles 7 and the locking wires 8 have left the fiber fleece 1, whereby the fleece 1 was abutts against the knock-over comb 11, the warp thread loops are being pulled by the needle shanks to form the stitches 3. At the same time, all fibers 5 abutting closely to the needle shanks slip also off so as to create the interlacing type 5*c*, which sometimes is as long as the fiber hooks 5*d*. The fibers 5, which now become stitch-like hooks 5*d*, still have such a length that they remain in the plane of the slide needles 7, and for which reason during the next forward movement of the slide needles 7 the needles pass through them. The knock-over or pulling-down, respectively, of the stitch like fiber hooks 5*d* occur in this case, when the next stitches 3 slide off from the slide needles 7, as a rule, when two consecutive stitches 3 of a longitudinal row 2 have been produced. For this reason, the stitch like fiber hooks 5*d* are twice as long as the stitches 3. Of course, the new warp thread loops are being pulled with the new fibers 5 through the old loops. After the slide needles 7 and the locking wires 8 have reached their rearwardmost position again, there then starts a new cycle of stitch-formation and integration of fibers 5 into the stitches 3. The fibers 5 or 5*a* to 5*d*, respectively, which had been integrated into the stitches 3 are then the means by which the stitches are insensitive to ripping of threads and why they resist the formation of runs; that is, the integration of the fibers 5–5*d*** with the warp thread stitches prevent runs.

What is claimed is:

1. A warp knitting machine, particularly a sewing-knitting machine for the production of a sewn-knitted fabric made of fleece, preferably fiber fleece, comprising a row of side-by-side pointed slide needles, which can be locked by means of respective locking wires, thread guiding eye needles which are located opposite the slide needles, a knock-over comb, a counter hold comb for the supporting the fleece during its travel past and during the piercing of the needles and a fleece retainer bar which limits the passage space for the fleece, said bar being disposed below the slide needles, as well as opposite the knock-over comb, characterized in that the counter holding comb 12 is a rigid arrangement, non-flexible and non-yielding to the forces engendered by the slide needles piercing the fleece and extends at an angle to the slide needles 7 and itself comprising free ended non-yielding sinker shaped prongs 14 the ends 14*a* of which are disposed opposite the points of the slide needles, said ends 14*a* being disposed laterally outwardly of the inner surface 13*a* of the fleece retainer bar 13 and upstream in the sense of fleece travel of the fleece retainer bar 13, the fleece retainer bar being spaced downstream of the sinker shaped prongs 14.

2. Warp knitting machine, particularly a sewing knitting machine, for the production of a sewn-knitted fabric made of fleece, preferably fiber fleece, and reinforced by parallel rows of thread stitches, comprising a row of side-by-side pointed slide needles which can be locked by means of respective locking wires, a knock-over comb, a counter hold comb for supporting the fleece during its travel past and during the piercing of the needles and a fleece retainer bar which limits the passage space for the fleece, said bar being disposed below the slide needles, as well as opposite the knock-over comb, characterized in that the counter hold comb 12 is a rigid arrangement, non-flexible and non-yielding to the forces engendered by the slide needles piercing the fleece and extends at an angle to the slide needles 7 and itself comprising free ended non-yielding sinker shaped prongs 14, disposed opposite the points of the slide needles, and the bar 13 is spaced downstream of the sinker shaped prongs 14 and below the plane of the slide needles 7.

3. Warp knitting machine, according to claim 7, characterized in that the upper edge 13*b* of the bar 13 is spaced vertically and horizontally from the outer ends 14*a* of the sinker shaped prongs 14.

4. Warp knitting machine according to claim 2 characterized by in that the outer ends 14*a* of the sinker shaped prongs 14 are positioned approximately at the level of the lower edges of the slide needles.

5. Warp knitting machine according to claim 2, characterized in that the sinker shaped prongs 14 each have a point with a slanted edge disposed opposite and facing a respective eye-pointed needle, the sides of the prongs facing the slide needles lying in the vertical.

6. Warp knitting machine according to claim 2, characterized in including means for completely penetrating the fiber fleece with the slide needles 7 and the locking wires 8.

7. A warp knitting machine according to claim 2 wherein the counter hold comb is supported by universally adjustable means.

8. A warp knitting machine according to claim 2 wherein the sinker bar is supported for universal adjustment.

9. The warp knitting machine of claim 2, wherein said slide needles are disposed to face the "right" side of the fleece during its travel past said needles, each of which includes a hook adjacent the pointed end thereof and which draws fiber from said fleece after it has pierced the same and returns past said "right" side of the fleece, means are provided for moving the fleece stitch distances and further means are provided for withdrawing said hooks of said needles and the fibers carried therein to a distance from the "right" side of the fleece greater than a stitch distance.

10. A method for the production of warp knitted fabric, which fabric comprises a fleece reinforced with parallel rows of thread stitches insensitive with regard to laddering because of fibers from the fleece surrounding the thread thereof within and extending from the holes of the rows of stitches and interlaced with the stitches, the fabric being produced upon a knitting machine which comprises a row of side-by-side hooked and pointed slide needles, the hooks of which extend forwardly from the shanks thereof and which can be closed by means of respective locking wires and a knock-over comb for sliding formed stitches off the needles on the "right" side of the path of travel of the fleece, a counter hold comb for supporting the fleece during the piercing of the needles through the fleece and a fleece retainer bar downstream of the counter hold comb for limiting the passage space for the fleece on the "left" side of the path of travel of the fleece, and means for feeding thread to the hooks of the needles on the "left" side of the fleece, said method comprising passing the fleece past the needles a stitch length at a time, piercing the fleece completely with the hooks of the needles and the respective locking wires and closing said hooks with said locking wires in the vicinity of the "left" side of the fleece, during the return stroke of the needle.

11. The method according to claim 10, wherein said distance from the right side of the fleece is more than two times the distance of a stitch length.

12. The method according to claim 10, including drawing some of the fibers in the form of loops to the rearmost position of the needles, retaining the loop shaped fibers in the working plane of the slide needles during the knock-over process for the thread stitches, forwarding said needles again to pierce the fleece and further drawing thread and fibers rearwardly and repeating such piercing and fiber drawing, and thrusting off from the slide needles said loop shaped fibers after they have been situated on the shafts of the slide needles during two consecutive piercing and withdrawing operations.

13. The method of claim 10, in which the distance the fibers are drawn is of two consecutive stitch holes 4 of a row 2.

14. The method of claim 13 wherein the fibers 5 subsequently are disposed upon the shank of a slide needle 7 and, during an ensuing knock over procedure relative to previously formed stitch 3, they remain in a loop shape in the plane of the slide needles 7, and the loop is subsequently passed through by the slide needle 7 during repeated advances so as to re-appear on the shank of the slide needle 7, and then passed through loop of fibers 5, after they have been present on the shank of the slide needle 7 at least twice, is then knocked off of the slide needle 7.

* * * * *